US005609389A

United States Patent [19]

Longoria et al.

[11] Patent Number: 5,609,389

[45] Date of Patent: Mar. 11, 1997

[54] COLLAPSIBLE BOOSTER SEAT

[75] Inventors: Jose Longoria, Miami, Fla.; Stephen P. Chininis, Norcross, Ga.

[73] Assignee: Kids II, Inc., Alpharetta, Ga.

[21] Appl. No.: 506,109

[22] Filed: Jul. 24, 1995

[51] Int. Cl.[6] ..... A47D 1/10

[52] U.S. Cl. ..... 297/37; 297/54; 297/183.5; 297/250.1; 297/411.34; 297/153

[58] Field of Search ..... 297/17, 37, 54, 297/183.5, 250.1, 256.11, 153, 411.34

[56] References Cited

U.S. PATENT DOCUMENTS

| | | | |
|---|---|---|---|
| 592,695 | 10/1897 | Coonrod | 297/37 |
| 1,419,947 | 6/1922 | Schouten | 297/37 |
| 1,424,302 | 8/1922 | Helms | 297/411.34 X |
| 1,739,366 | 12/1929 | Lang | 297/37 |
| 2,496,205 | 1/1950 | Grieb | 297/250.1 |
| 2,528,676 | 11/1950 | Walters | 297/37 X |
| 2,555,566 | 6/1951 | Bleck | 297/37 X |
| 3,674,306 | 7/1972 | Botney | 297/183.5 X |

*Primary Examiner*—Peter R. Brown
*Attorney, Agent, or Firm*—Beveridge, DeGrandi, Weilacher & Young, L.L.P.

[57] ABSTRACT

A collapsible booster seat has a seat member, a back member connected to the seat member, two side members connected to the seat member, and a tray. A backrest portion of the back member is movable from a normal use position which is perpendicular to the seat member to a collapsed position which is parallel to the seat member. The seat member has two rear extensions which are laterally spaced from each other, and the back member has an auxiliary panel which provides a seating area between the rear extensions when the booster seat is in its normal use configuration. The back is supported on the seat for pivotal movement about a transverse pivot axis which extends through the rear extensions and through a forward portion of the auxiliary panel of the back member. Each of the side members is connected to the seat member for pivotal movement about a longitudinal pivot axis so that the side members can move between a normal use position which is perpendicular to the seat member and a collapsed position which is parallel to the seat member. To retain the side members in their normal use positions, the booster seat has locking mechanisms which releasably connect the side members to the back member. Links connect the back member to the side members in order to move leg portions of the side members inwardly in response to movement of the backrest to its collapsed position.

14 Claims, 5 Drawing Sheets

COLLAPSIBLE BOOSTER SEAT

BACKGROUND OF THE INVENTION

This invention relates to a booster seat which can be placed on an adult-sized chair and can be used by a child during eating, playing, or other activities.

A booster seat generally has a seat portion, two side portions which are located on opposite sides of the seat, a back portion, and a tray. It can be placed directly on the floor, attached to a chair, and used with or without the tray during playing and eating activities. In some instances, the seat, sides and back are rigidly connected together but, for convenient storage and transportation, some booster seats are collapsible to varying degrees. In one case, the back is pivotally attached to the sides so it can swing from a vertical position to a horizontal position where the back will lie beneath a tray which is fixed to the arms. In another product, the sides are connected to the back by vertical pivots, and the seat is a removable cushion. For storage and transportation purposes, the seat cushion is laid parallel against the back, and the sides are pivoted inwardly so that the seat is housed between the back and the inwardly-pivoted sides.

In still another prior art collapsible booster seat, the back is connected to the sides by aligned transverse pivots which permit the back to swing from a vertical normal use position to a horizontal position where it is located between the sides. In this device, the longitudinal edges of the seat are slidably mounted in longitudinally extending slots on the inboard sides of the arms. Multiple slots are provided to provide for varying seat heights. The lower end of the back has a hand hole which provides a handle for convenient carrying. To collapse this booster seat, the back is pivoted from its upright vertical position to a horizontal position where it lies between the sides and against the seat.

The present invention utilizes a different collapsing principle from the prior art devices described in the preceding paragraphs. It provides for a very compact collapsed structure which is conveniently stored, transported, and restored to its normal use position.

The invention may take many forms, only a preferred example of which is described in the following specification.

SUMMARY OF THE INVENTION

A collapsible booster seat according to the invention has a seat member for supporting a seated occupant, a back member which is connected to the seat member, and two side members which are connected to the seat member. The back member is connected to the seat member for pivotal movement about a transverse pivot axis so that a backrest portion of the back member is movable from a normal use position which is perpendicular to the seat member to a collapsed position which is parallel to the seat member. Each of the side members has an upper arm portion and a lower leg portion, and each side member is connected to the seat member for pivotal movement about a longitudinal axis so that the side members can move between a normal use position which is perpendicular to the seat member and a collapsed position which is parallel to the seat member. The side members are parallel to each other and they are perpendicular to the back member when the booster seat is in its normal use configuration.

The invention includes a number of optional but desirable features. For example, to coordinate the collapsing action of the booster seat, it preferably includes links or other means connecting the back member to the side members for moving the leg portions inwardly in response to movement of the backrest portion to its collapsed position. The booster seat has a handle which facilitates carrying the booster seat when it is in its collapsed configuration. The handle is attached to the back member and, when the booster seat is in its normal use configuration, the handle lies at a lower elevation than the seat member.

Other desirable features include a tray which can be located between the backrest portion and the seat member when the booster seat is in its collapsed configuration. When the side members are in their normal use positions, the tray is mounted on the arm portions. The tray has a lower surface provided with a transverse guide portion, and the arms of the side members have grooves which receive the guide portion to prevent the tray from moving in a longitudinal direction relative to the side members when the booster seat is being moved from its normal use configuration to its collapsed configuration.

The seat member may include two rear extensions which are laterally spaced from each other, and the back member may have an auxiliary panel which lies between these rear extensions. The auxiliary panel provides a seating area between the rear extensions of the seat member when the booster seat is in its normal use configuration. The transverse pivot axis extends through the rear extensions of the seat member and through a forward portion of the auxiliary panel of the back member.

Locking means are provided to releasably connect the side members to the back members to retain the side members in their normal use positions. The seat member has side edges which are laterally outboard of the longitudinal pivot axes about which the side members are pivoted. Each of the side members has an upwardly-facing shoulder which contacts and supports the seat member when the booster seat is in its normal use configuration. The arm portions are entirely laterally outboard of the seat member when the booster seat is in its collapsed configuration. When the booster seat is in its collapsed configuration, the leg portions are in coplanar, nonoverlapping relation to each other.

DETAILED DESCRIPTION

Figure 1:
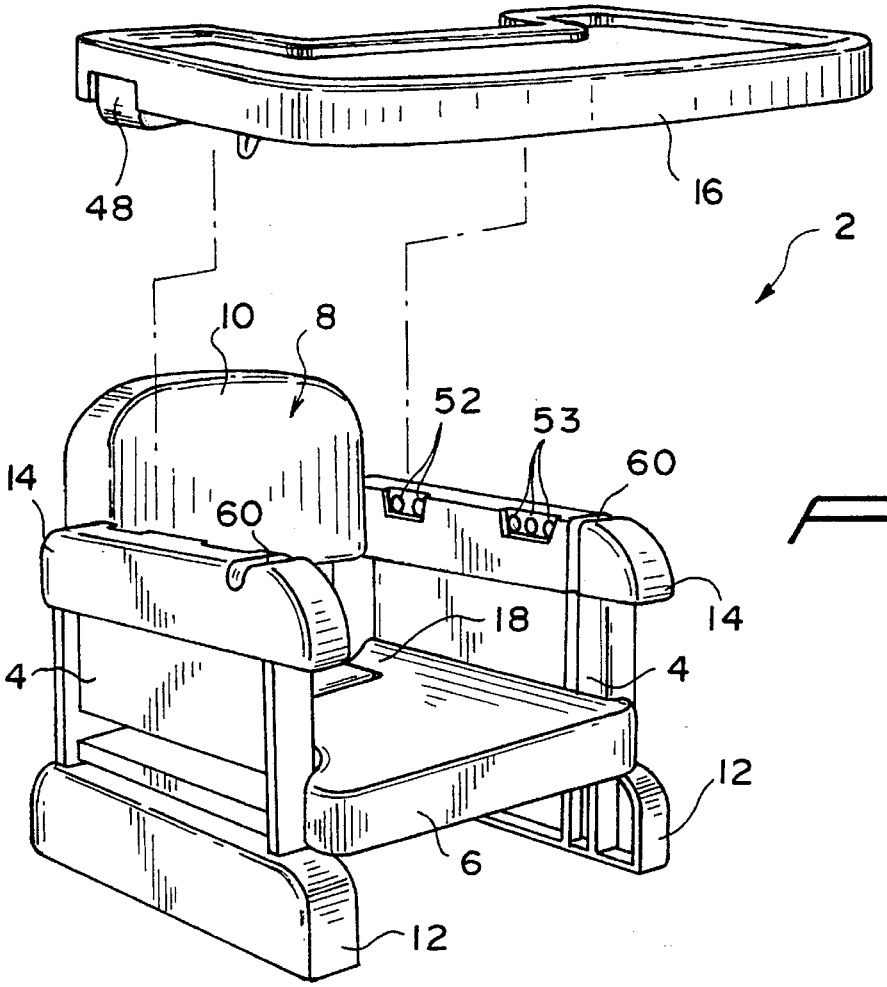
FIG. 1 is a perspective view of a booster seat according to the invention in its normal use configuration, except that it is exploded to show the tray at an elevated position.
Figure 2:
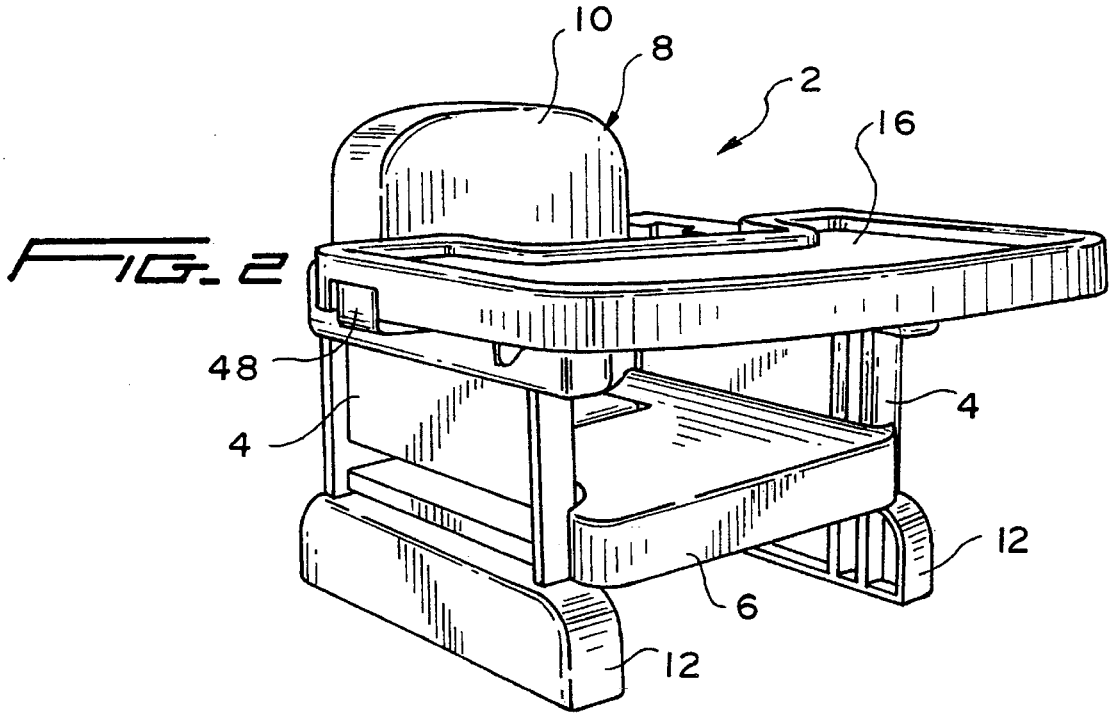
FIG. 2 is perspective view of the preferred embodiment in which the tray is mounted on the arms at a normal use position.

A booster seat according to the invention, in its normal use configuration, is shown in FIGS. 1 and 2. It includes two side members 4, a horizontal seat member 6 which is connected to and supported by the side members 4, and a back member 8 which is connected to and supported by the seat member 6. The back member 8 has a backrest portion 10 which, in the normal use position shown in FIG. 1, is vertical and perpendicular to the side members 4 and the seat member 6. Each of the side members 4 has a lower leg portion 12, an upper arm portion 14, and a midportion which rigidly connects together the lower leg portion 12 and upper arm portion 14. As shown in FIG. 2, the tray 16 is supported by the arms 14. As will be explained later in connection FIGS. 9, 10, and 11, the tray 16 is releasably connected by a latch 48 to the arms 14. In the normal use configuration, the side members 4 are perpendicular to the seat member 6, they are parallel to each other, and they are perpendicular to the back member 8.

Figure 3:
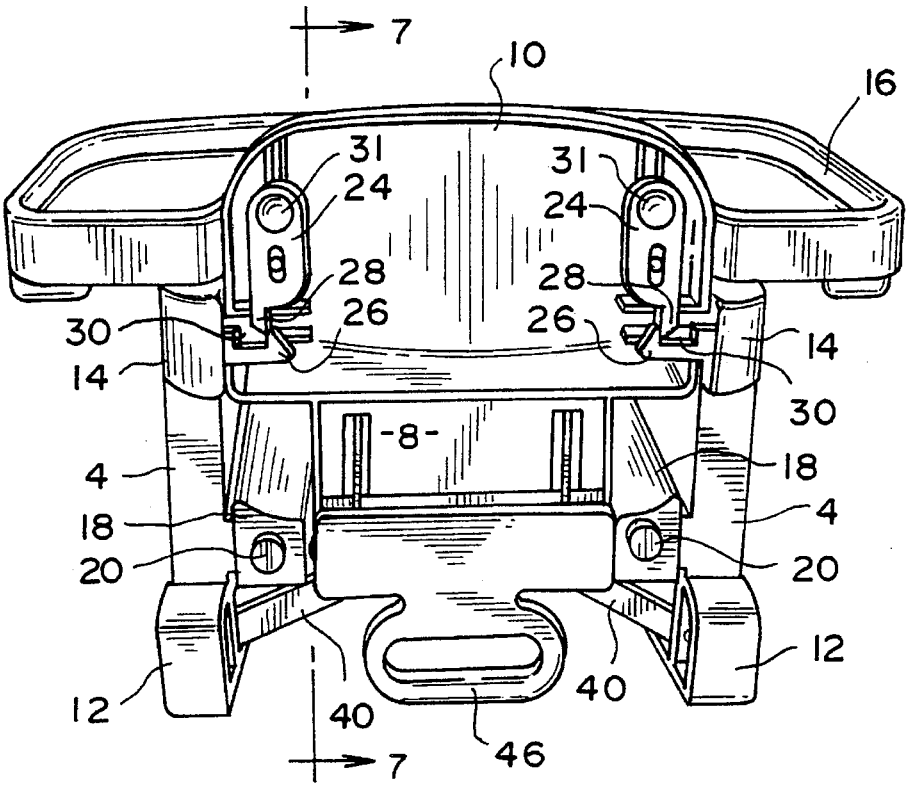
FIG. 3 is a rear perspective view of the booster seat in its normal use configuration.

FIG. 3 shows the rear of the booster seat 2 in its normal use configuration. As seen here, the seat member 6 has two parallel rear extensions 18 which are laterally spaced from each other. The side members 4 are pivotally connected to the seat member 6 by longitudinal pivots 20. The side edges of the seat 6 are laterally outboard of the axes of the pivots 20. The pivots 20 permit the side members 4 to move from the vertical positions shown in FIG. 3 to the horizontal collapsed positions shown in FIG. 5 where their leg portions 12 are beneath the seat 6 and in coplanar non-overlapping relation to each other. In this collapsed configuration, the entire armrest portions 14 are below and laterally outboard of the seat member 6.

Figure 4:
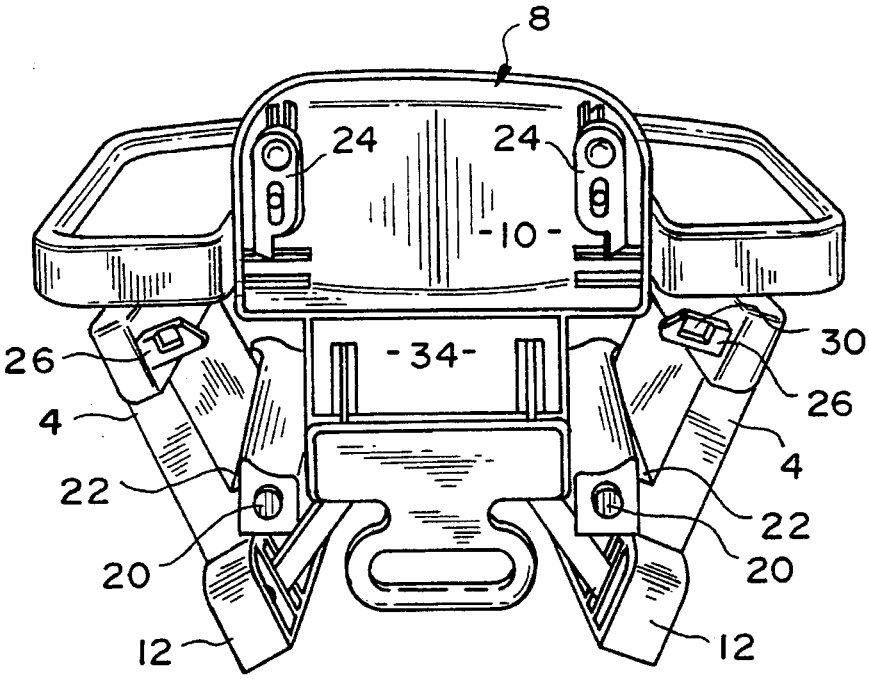
FIG. 4 is a view similar to FIG. 3 but showing the booster seat in transition from its normal use configuration to its collapsed configuration.

The booster seat is releasably locked in its seating configuration by a locking means, shown in FIGS. 3 and 4, which releasably interconnect the back member 8 to the side members 4, thus retaining the side members in their normal use positions. Each locking means includes a sliding latch 24 mounted on the back member 8, and a rigid catch 26 which extends inwardly from one of the arms 14 of a side member 4. Each latch 24 is slidably and non-rotatably mounted on the rear surface of the backrest 10, and it is moved downwardly by a spring (not shown) so that the lower latching end 28 thereof will project into the recess 30 of a respective catch 26. The latches have fingertip-receiving recesses 31 which are used to lift the latches 24 against the spring bias. This withdraws the latching ends 28 from the recesses 30 of catches 26, thus freeing the side members 4 to swing on the pivots 20, first to an intermediate position shown in FIG. 4 and then to the fully collapsed position shown in FIG. 5.

Figure 7:
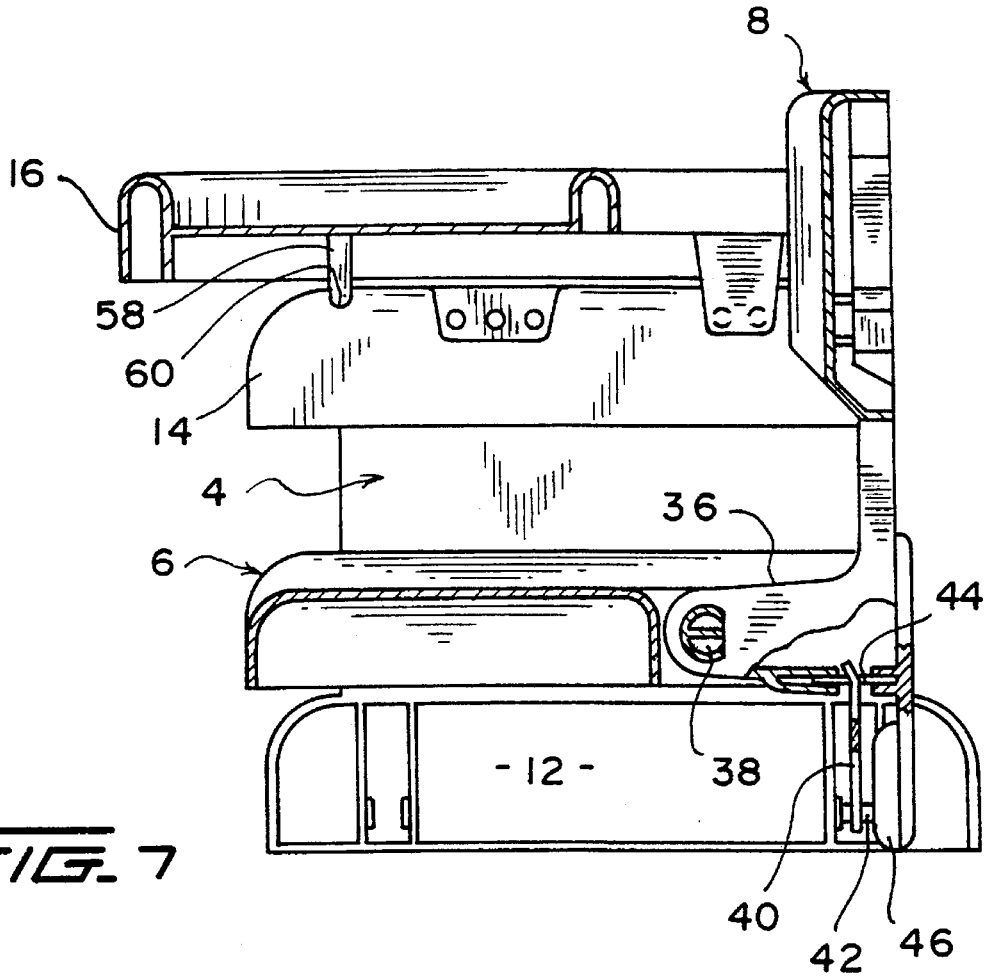
FIG. 7 is a sectional view seen along the line 7—7 in FIG. 3 showing the booster seat in its normal use configuration.
Figure 8:
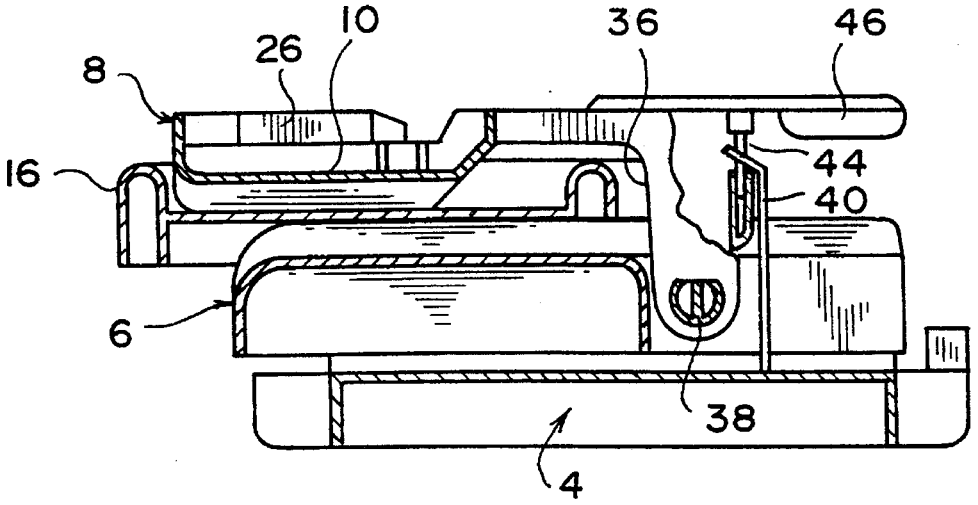
FIG. 8 is a sectional view taken in the same plane as FIG. 7 but showing the booster seat in its collapsed configuration.

Simultaneously with the movement of the side members 4 to their collapsed positions, the back member 8 moves from its normal position shown in FIG. 7 to a collapsed position shown in FIG. 8, where its backrest portion 10 is horizontal and parallel to the seat member 6.

Referring to FIGS. 7 and 8, it will be seen that the back member is generally L-shaped in transverse cross section. It has the upper backrest portion 10, a lower backrest portion 34, and an auxiliary panel 36. The auxiliary panel 36 lies between the rear extensions 18 of the seat member 6, and its forward end is connected to the rear extensions 18 by a transverse pivot 38. Thus, the pivot axis of the back member extends through the rear extensions 18 and a forward portion of the auxiliary panel 36. In the normal seating configuration shown in FIG. 7, the upper surface of the auxiliary panel 36 is coplanar with the upper surface of the seat member 6, and it provides a seating area between the rear extensions 18 of the seat member 6. When the back member 8 is in its collapsed position shown in FIG. 8, the auxiliary panel 36 is vertically oriented, and it creates a vertical space for the tray 16 which lies between the seat member 6 and the portions 10 and 34 of the back member 8.

The movement of the back member 8 to its collapsed position is preferably coordinated with the movements of the side members 4 to their collapsed positions. In the disclosed embodiment, two links 40 coordinate these movements. As best shown in FIG. 7, each of these links 40 has a lower end which is pivotally mounted on a pin 42 on a leg portion 12, and an upper end which is pivotally mounted on a pin 44 on the auxiliary panel 36 of the back member 8. These links move the leg portions 12 inwardly in response to movement of the back member 8 to its collapsed position. Thus, movement of the back member 8 to its collapsed position places the links 40 under tension, and the links 40 first move the side members 4 to their intermediate positions shown in FIG. 4, and then to their collapsed positions shown in FIG. 5.

Figure 5:
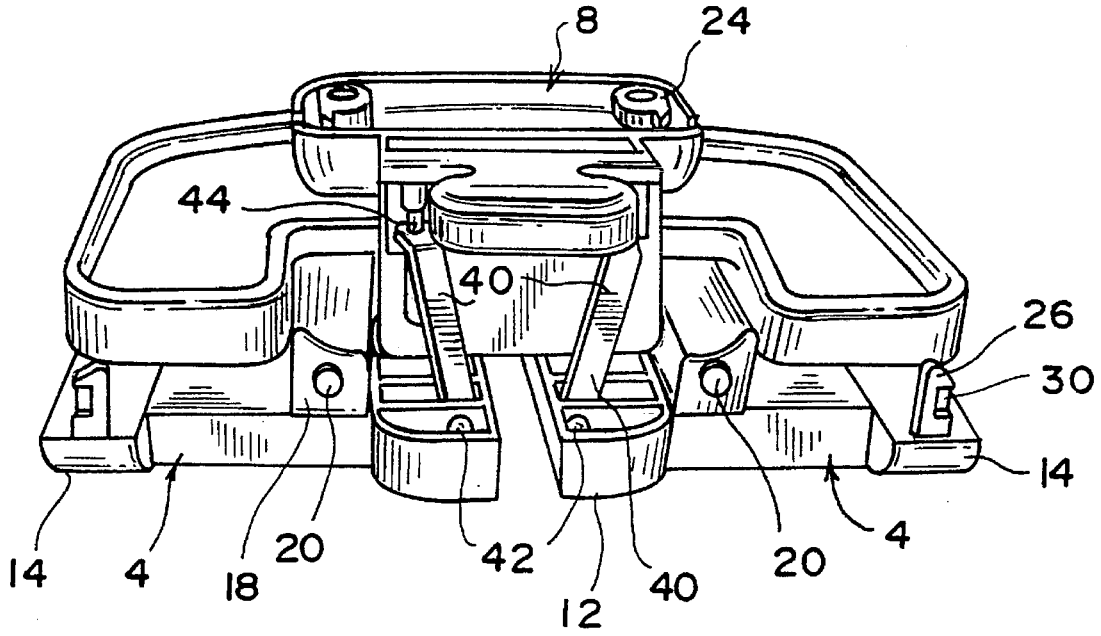
FIG. 5 is a view taken from the same vantage point as FIGS. 3 and 4, but showing the booster seat in its fully collapsed configuration.
Figure 6:
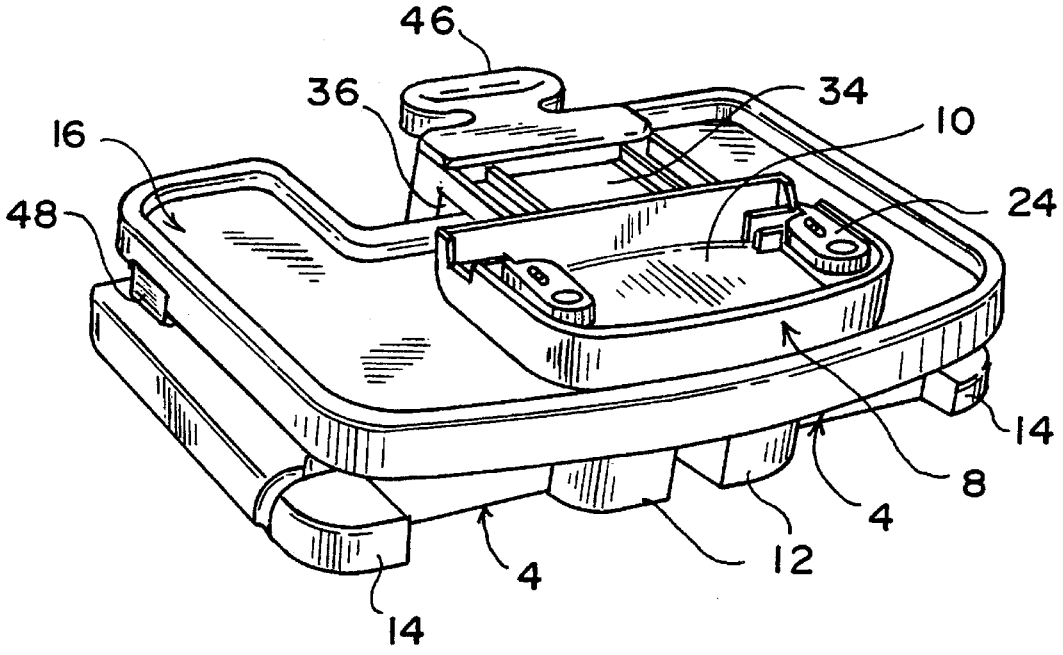
FIG. 6 is a front perspective view showing the booster seat in its fully collapsed configuration.

To maintain the booster seat in its collapsed configuration, a removable or releasable blocking member may be provided to engage the links 40 and prevent them from moving downwardly or outwardly from the position shown in FIG. 5. For example, the handle can be pivotally mounted on the back member, and blocking members for blocking outboard movement of the links 40 can be fixed to the handle. The handle can then be pivoted between a link-releasing position and a link-blocking position where the blocking members on the handle immobilize the links 40 to hold the booster seat in its collapsed configuration.

As shown in FIGS. 5 and 8, the booster seat 2 is quite compact when it is collapsed. The seat member 6, side members 4, tray 16, and backrest 10 are parallel to each other. For ease of portability, a carrying handle 46 is fixed to the back member 8. This handle 46 lies at a lower elevation than the seat member 6 when the booster seat 2 is in the normal use configuration as shown in FIG. 3. This handle location is unobtrusive during normal use.

Figure 9:
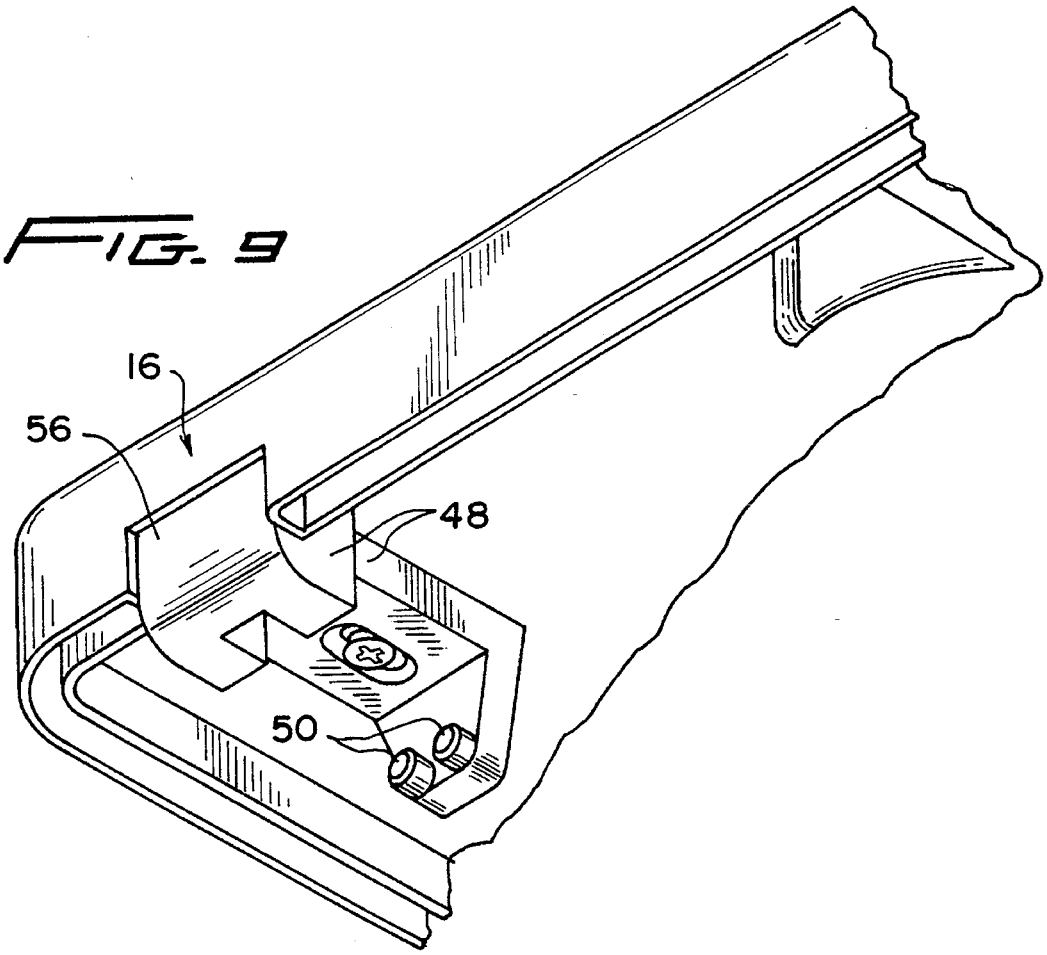
FIG. 9 is an upwardly-looking perspective view of a portion of the tray illustrating the latch mechanism which is used therein.
Figure 10:
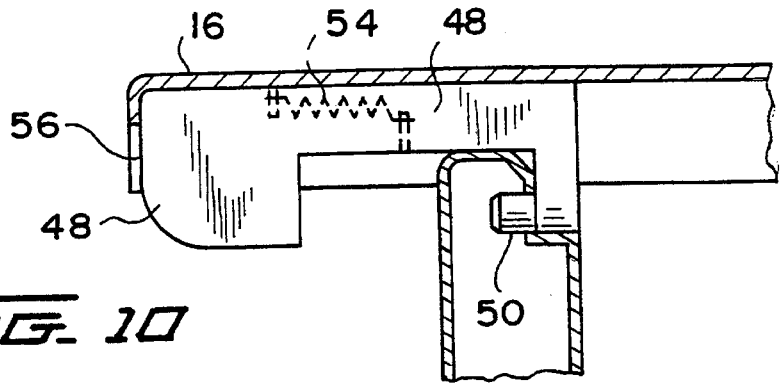
FIG. 10 is a sectional view showing the tray latch engaged with the arm of the booster seat.
Figure 11:
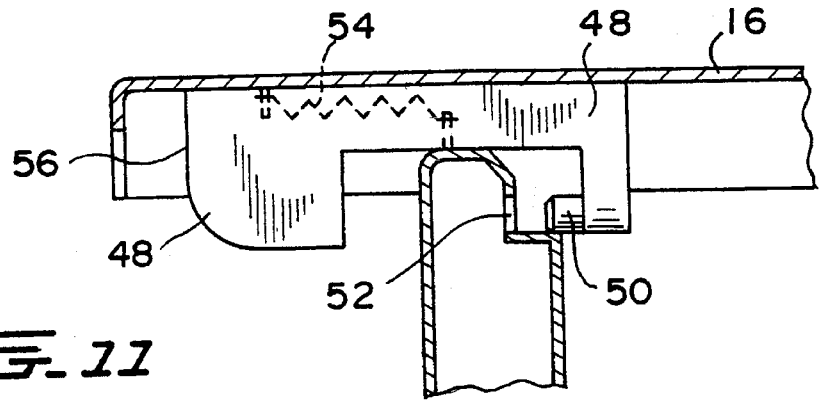
FIG. 11 is a view similar to FIG. 10 but showing the latch in its retracted or disengaged position.

The tray 16 is connected to the booster seat by the latching arrangement shown in FIGS. 9, 10, and 11. Opposed latches 48 have latch pins 50 which fit into inwardly facing holes 52, 53 which are molded into the armrests 14. As shown in FIG. 9, each of these latches has two pins 50 which project in an outboard direction. The latch 50 is laterally slidable, and it is biased outwardly by a spring 54. The outer surface 56 of the latch 48 is exposed so it can be pressed in to slide the latch 48 from a latched position shown in FIG. 10 to an unlatched position shown in FIG. 11 where the pins 50 are withdrawn from the holes 52.

As shown in FIG. 1, there are two rear holes 52 and three forward holes 53. The rear holes 52 are used for retaining the tray on the arms when the booster seat is unoccupied. When the booster seat is occupied, any adjacent two of the three forward holes 53 are used. The distance between adjacent holes 53 is equal both to the spacing between the pins 50 and to the spacing between the holes 52. By using the two forward holes 53, the tray will be slightly forward of the position it occupies when using the two rear holes 53.

On the lower surface of the tray 16, as shown in FIG. 7, there is a transverse guide member 58 which rests in grooves 60 formed in the armrest portions when the pins 50 of the tray latch 48 are engaged with the two rear armrest holes 52. The guide 58 and grooves 60 prevent the tray form moving longitudinally relative to the side members 4 when the booster seat is being moved between the normal use configuration shown in FIGS. 3 and 7 and the collapsed configuration shown in FIGS. 5 and 8.

Persons familiar with the field of the invention will realize that the invention can be practiced by many structures other than those specifically disclosed herein. Although the preferred material for most components is molded plastic, other materials may be used. Different configurations, latches, and other elements may be utilized. It is unnecessary to provide all of the desirable features disclosed in this specification. Thus, it is emphasized that the invention is not limited solely to the disclosed embodiment but is embracing of modifications, variations, and improvements which fall within the spirit of the following claims.

We claim:

1. A collapsible booster seat which is collapsible from a normal use configuration to a collapsed configuration, comprising a seat member for supporting a seated occupant, a back member which is connected to said seat member for pivotal movement about a transverse pivot axis, said back member having a backrest portion which is movable from a normal use position which is perpendicular to the seat member to a collapsed position which is parallel to the seat member;

two side members, each of said side members having an upper arm portion and a lower leg portion, said arm portion and said leg portion of each side member being rigidly connected together, each of said side members being connected to said seat member for pivotal movement about a single longitudinal pivot axis which is stationary with respect to the seat member and the respective side member;

each of said side members being movable about its said longitudinal pivot axis between a normal use position which is perpendicular to the seat member and a collapsed position which is parallel to the seat member, said side members being parallel to each other and perpendicular to the back member when said booster seat is in its normal use configuration, said arm portions extending laterally outboard of the seat member when the booster seat is in its collapsed configuration.

2. A collapsible booster seat according to claim 1, wherein the seat member has side edges which are laterally outboard of said longitudinal pivot axes about which the side members are pivoted.

3. A collapsible booster seat according to claim 1 having a handle for carrying the booster seat when it is in its collapsed configuration, said handle being attached to the back member and lying at a lower elevation than the seat member when the booster seat is in its normal use configuration.

4. A collapsible booster seat according to claim 1 including means connecting the back member to the side members for moving the leg portions inwardly in response to movement of the backrest portion to its collapsed position.

5. A collapsible booster seat according to claim 1 wherein the backrest portion is spaced from the seat member when the backrest portion is in its collapsed position, said booster seat including a tray which is located between the backrest portion and the seat member when the booster seat is in its collapsed configuration.

6. A collapsible booster seat according to claim 1 including a tray which is mounted on the arm portions when the side members are in their normal use positions.

7. A collapsible booster seat according to claim 6 wherein the tray has a lower surface provided with a transverse guide portion, and the arm portions of the side members have grooves which receive said guide portion to prevent longitudinal movement of the tray relative to the side members when the booster seat is being moved from its normal use configuration to its collapsed configuration.

8. A collapsible booster seat according to claim 1 including locking means which releasably connects the side members to the back member to retain the side members in their normal use positions.

9. A collapsible booster seat according to claim 1 wherein the leg portions are in coplanar nonoverlapping relation to each other when the booster seat is in its collapsed configuration.

10. A collapsible booster seat according to claim 1 wherein each of said side members includes an upwardly-facing shoulder which contacts and supports the seat member when the booster seat is in its normal use configuration.

11. A collapsible booster seat which is collapsible from a normal use configuration to a collapsed configuration, comprising a seat member for supporting a seated occupant, a back member which is connected to said seat member for pivotal movement about a transverse pivot axis, said back member having a backrest portion which is movable from a normal use position which is perpendicular to the seat member to a collapsed position which is parallel to the seat member;

two side members, each of said side members having an upper arm portion and a lower leg portion, each of said side members being connected to said seat member for pivotal movement about a longitudinal pivot axis;

each of said side members being movable about its said longitudinal pivot axis between a normal use position which is perpendicular to the seat member and a collapsed position which is parallel to the seat member, said side members being parallel to each other and perpendicular to the back member when said booster seat is in its normal use configuration;

said seat member including two rear extensions which are laterally spaced from each other, said back member including an auxiliary panel which lies between the rear extensions of the seat member, said auxiliary panel of the back member providing a seating area between the rear extensions of the seat member when the booster seat is in its normal use configuration.

12. A collapsible booster seat according to claim 11 wherein said transverse pivot axis extends through said rear extensions of the seat member and through a forward portion of the auxiliary panel of the back member.

13. A collapsible booster seat according to claim 12 including a tray which is located between the backrest portion and the seat member when the booster seat is in its collapsed position.

14. A collapsible booster seat which is collapsible from a normal use configuration to a collapsed configuration, comprising a seat member for supporting a seated occupant, a back member which is connected to said seat member for pivotal movement about a transverse pivot axis, said back member having a backrest portion which is movable from a normal use position which is perpendicular to the seat member to a collapsed position which is parallel to the seat member;

two side members, each of said side members having an upper arm portion and a lower leg portion, said arm portion and said leg portion of each side member being rigidly connected together, each of said side members being connected to said seat member for pivotal movement about a longitudinal pivot axis;

each of said side members being movable about its said longitudinal pivot axis between a normal use position which is perpendicular to the seat member and a collapsed position which is parallel to the seat member, said side members being parallel to each other and perpendicular to the back member when said booster seat is in its normal use configuration;

means connecting the back member to the leg portions of the side members for moving the leg portions inwardly and for moving the arm portions outwardly in response to movement of the backrest portion to its collapsed position.

* * * * *